United States Patent [19]

Wilson

[11] 4,301,627

[45] Nov. 24, 1981

[54] GUARD RAILS FOR PORTABLE STAGES

[75] Inventor: Kermit H. Wilson, Edina, Minn.

[73] Assignee: Sico Incorporated, Minneapolis, Minn.

[21] Appl. No.: 67,409

[22] Filed: Aug. 17, 1979

[51] Int. Cl.[3] ..... E04G 1/26

[52] U.S. Cl. ..... 52/6; 182/113; 256/69

[58] Field of Search ..... 182/113, 82, 179, 178; 52/6-10; 256/DIG. 6, 65, 59; 108/27, 149

[56] References Cited

U.S. PATENT DOCUMENTS

| | | | |
|---|---|---|---|
| 3,181,203 | 5/1965 | Wenger | 52/7 |
| 3,333,807 | 8/1967 | Locatelli | 182/113 |
| 3,693,754 | 9/1972 | Butler | 182/113 |
| 3,747,898 | 7/1973 | Warren | 256/65 |
| 3,867,997 | 2/1975 | Hyslop | 256/65 |
| 3,920,221 | 11/1975 | Berry | 256/59 |
| 3,995,833 | 12/1976 | McLaughlin | 256/65 |

*Primary Examiner*—Reinaldo P. Machado

*Attorney, Agent, or Firm*—Merchant, Gould, Smith, Edell, Welter & Schmidt

[57] ABSTRACT

A protective barrier (14, 15) for removable installation at the edge of a stage surface member (12) supported on legs (13) and having a framing flange (13, 101), including a guard rail (20, 60), a member (24, 64, 103) for supporting the rail on the stage surface, apparatus including a plurality of hook members (25, 65, 104) for cooperating with the flange to prevent outward movement of the guard rail with respect to the surface member, and an arrangement including a locking member (40, 80), pivotable into an operative position in which it cooperates with the legs 11 to prevent outward tilting of the guard rail.

7 Claims, 6 Drawing Figures

Fig. 3
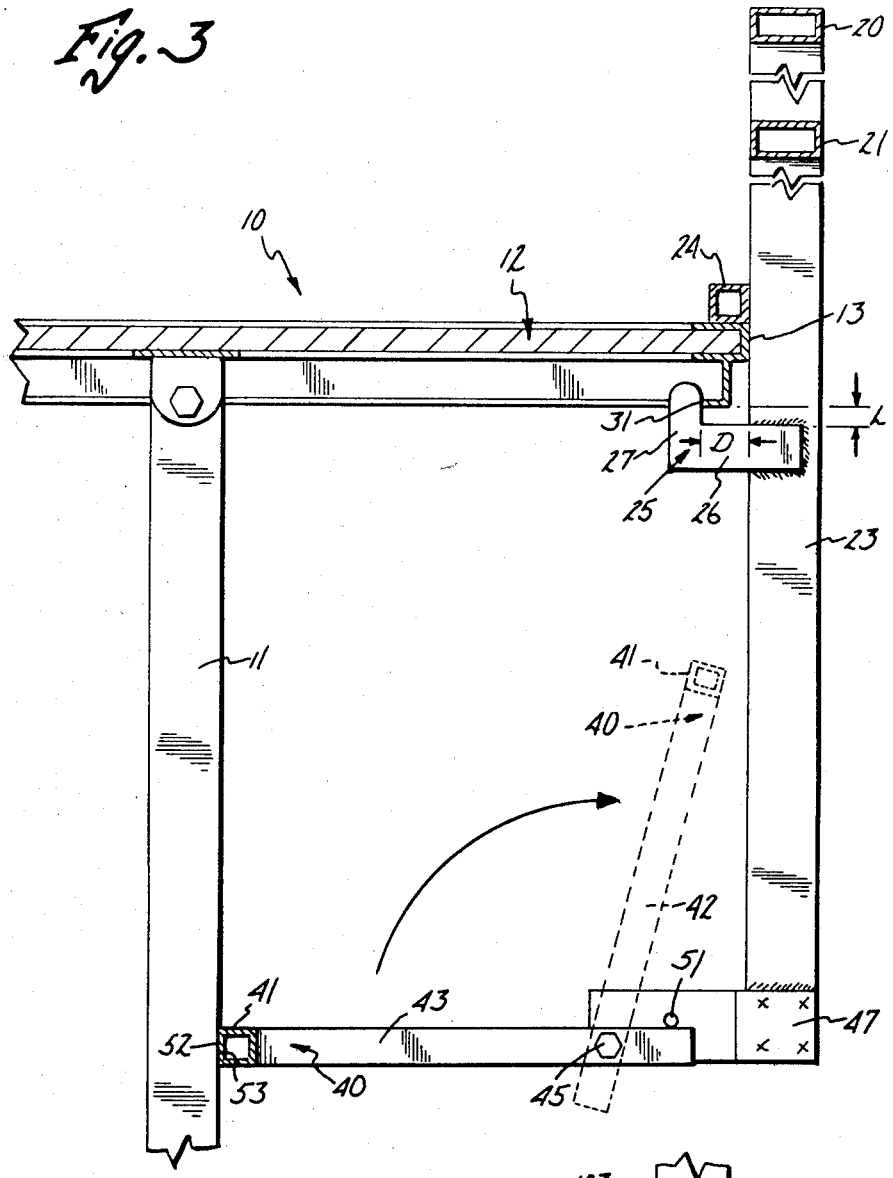
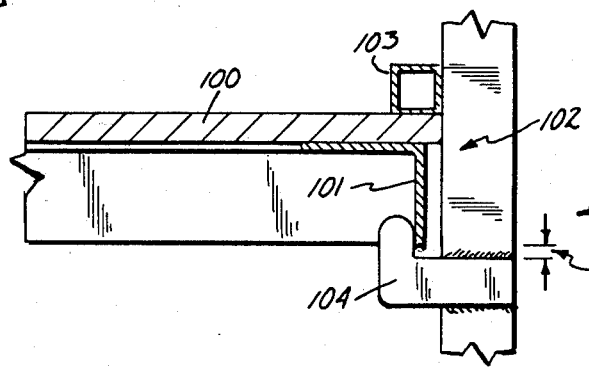
Fig. 6

GUARD RAILS FOR PORTABLE STAGES

TECHNICAL FIELD OF THE INVENTION

The present invention pertains to the field of portable stages and auxiliary equipment therefor. More particularly, the present invention pertains to guard rails which attach to the edges of portable stages for the safety of persons on the stage.

BACKGROUND OF THE PRIOR ART

Portable stages are widely used in institutions requiring multiple use facilities where it is sometimes necessary to set up a stage for use in a display or performance. Examples include convention centers, schools, hotels and the like. The portable stage sections may be used individually, or more commonly, a number of sections may be used adjacent each other and interconnected to form an extended stage area. Depending upon the use of the stage, there may be one or more persons on the stage during a performance, display or demonstration. It may be desirable to provide guard rails along one or more edges of the stage area for the protection of the persons on the stage. Depending upon the intended use for a given stage setup, it may not be necessary to have guard rails on every side of the stage. Also, when a large stage area is made up from a number of individual portable stage units, guard rails are undesirable for those stage sections in the interior of the assembly, while guard rails may, or may not be required for the sides or ends of those stage sections that form the perimeter of the stage area.

In view of these requirements, it is apparent that removable guard rails should be provided, so that the same type of portable stage unit could be used for an edge or an interior portion of an assembled larger stage by adding or removing the guard rails. In order to be economically feasible, the guard rails must be capable of mounting and dismounting from the stage with a minimum amount of time and manpower so that a stage can be quickly set up or taken down in a multiple use room. At the same time, however, the guard rail when mounted on the stage must be very rigid and secure and not subject to accidental dislodgement, since the persons on the stage may intentionally or accidentally lean on them with a great amount of force, and it must be remembered that some portable stage sections may extend to a considerable height above the floor of the room.

SUMMARY OF THE INVENTION

The present invention provides a removable protective barrier or guard rail for a stage that is very rigid, may be securely locked in its operative position, and yet may be removed or installed in a minimum amount of time without the use of tools or separable parts such as bolts or the like. The present invention achieves these objectives by providing a guard rail, means for supporting the guard rail on the edge of the stage surface member, means for normally preventing outward movement of the guard rail off the edge of the stage surface member, and means operable in a locking position to prevent outward tilting of the guard rail away from the stage surface.

According to a preferred embodiment, the protective barrier includes a top rail member and a pair of spaced posts with their top ends securing the top rail. A support member extends between the posts at a position lower than the top rail, for supporting the barrier by resting on the edge of the stage. Hook members connected to the posts below the support member extend inwardly and upwardly to engage a framing flange of the stage beneath the stage surface member. A locking member is pivotally connected to the posts below the hook members for engagement, in operative position, with the legs of the stage to prevent outward tilting and removal of the protective barrier.

BRIEF DESCRIPTION OF THE DRAWING

In the drawing

FIG. 3 is a fragmentary sectional view along the line 3—3 of FIG. 1;

FIG. 6 is a fragmentary sectional view like FIG. 3 but showing a barrier assembled to a stage of slightly different construction.

DETAILED DESCRIPTION OF THE INVENTION

Figure 1:
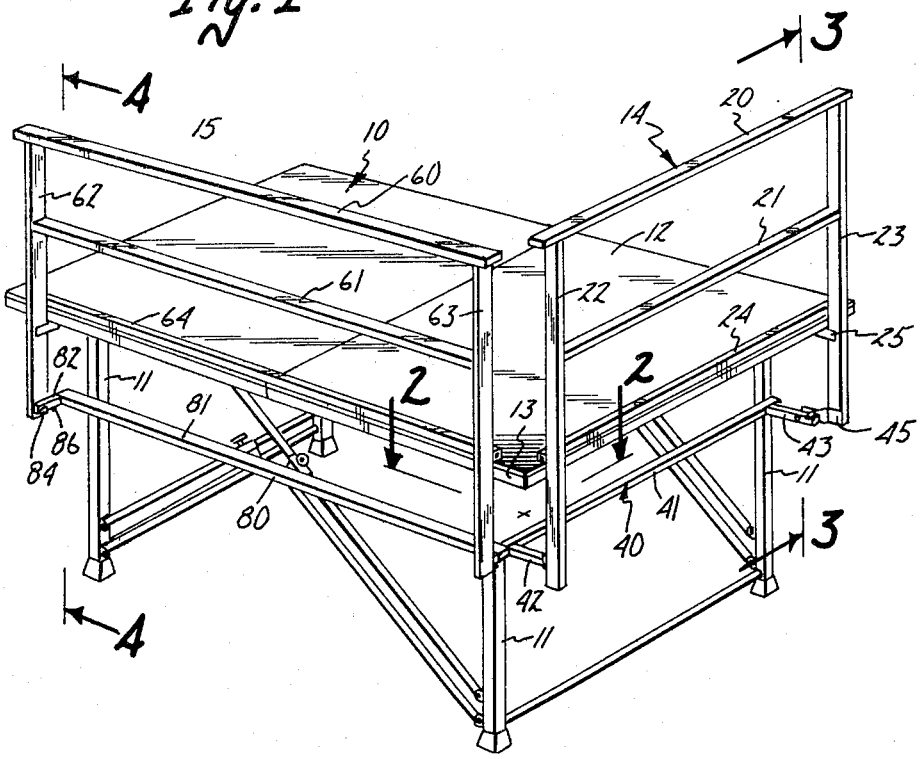
FIG. 1 is a perspective view of a small stage equipped with two barriers according to my invention.
Figure 2:
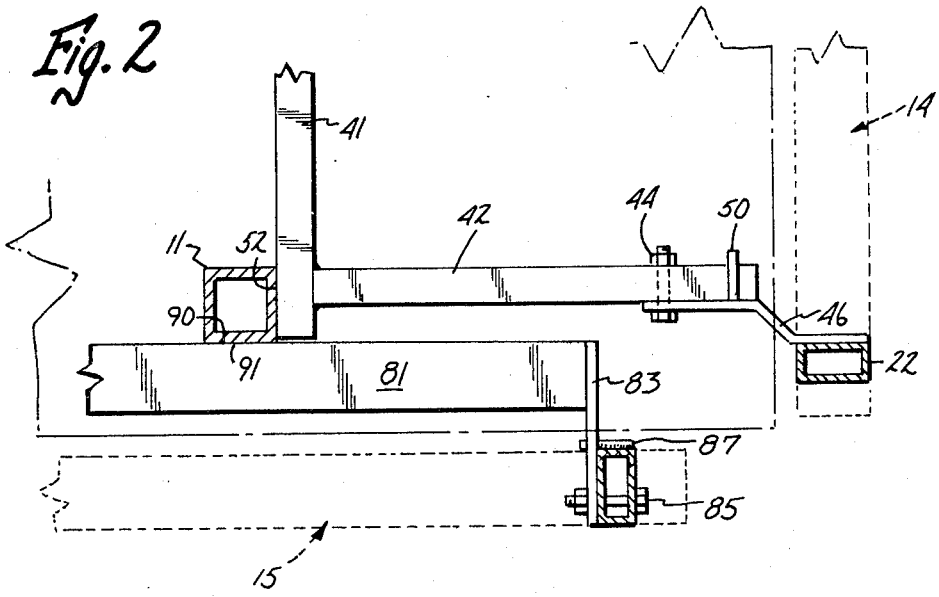
FIG. 2 is a fragmentary sectional view along the line 2—2 of FIG. 1.

FIGS. 1–3 show a stage 10 having elevating legs 11 and a surface member 12 including a framing flange 13. FIG. 1 suggests a folding stage as taught in U.S. Pat. No. 4,054,096, but this feature is not essential to the invention. Associated with stage 10 are an end barrier 14 and a side barrier 15 embodying the present invention.

Barrier 14 is shown to comprise a top rail 20 and an intermediate rail 21 secured to a pair of spaced posts 22 and 23 to form a rigid unit. An elongated support member 24 is secured at or near its ends to the inner surfaces of posts 22 and 23, and extends parallel to rail 20 to rest on surface member 12 along its edge. Each post includes a hook member 25 (see FIG. 3) secured rigidly thereto, and comprising an inwardly extending portion 26, an upwardly extending portion 27, and a termination 30 which may be specially shaped if desired, the inward extension D of the hook member being equal to the distance from the inner edge 31 of flange 13 to the outer edge of the surface member, and the upward extension being sufficient to engage member 13 at inner edge 31, but not to engage the under surface of member 12 when support member 24 is resting thereon.

Barrier 14 also includes a locking member 40, comprising a bar 41 of rectangular cross section pivotally connected by short stubs 42, 43 and pivot fasteners 44, 45 to offset brackets 46, 47 projecting inwardly from the bottoms of posts 22, 23 below the hook members. As shown in FIGS. 2 and 3, brackets 46 and 47 are provided with stop pins 50 and 51 to limit the counterclockwise pivotal movement of locking member 40 at a point where the member slopes very slightly downwards from fasteners 44, 45, at which point the inner surface 52 of bar 41 is substantially coincident with the outer surface 53 of leg 11.

Barrier 15 is generally the same in structure as that described above. It comprises a top rail 60 and an intermediate rail 61 secured to a pair of support posts 62 and 63 to form a rigid unit. An elongated support member 64 is secured at or near its ends to the inner surfaces of posts 62 and 63, and extends parallel to rail 60 to rest on surface member 12 along its edge. Each post includes a hook member 65 (see FIG. 4) secured rigidly thereto, and comprising an inwardly extending portion 66, an upwardly extending portion 67 and a termination 70, which may be specially shaped if desired, the inward extension d of the locking member being equal to the distance from the inner edge 31 of flange 13 to the outer edge of the surface member, and the upward extension being sufficient to engage member 13 at inner edge 31, but not to engage the under surface of traffic member 12 when support member 64 is resting thereon.

Figure 4:
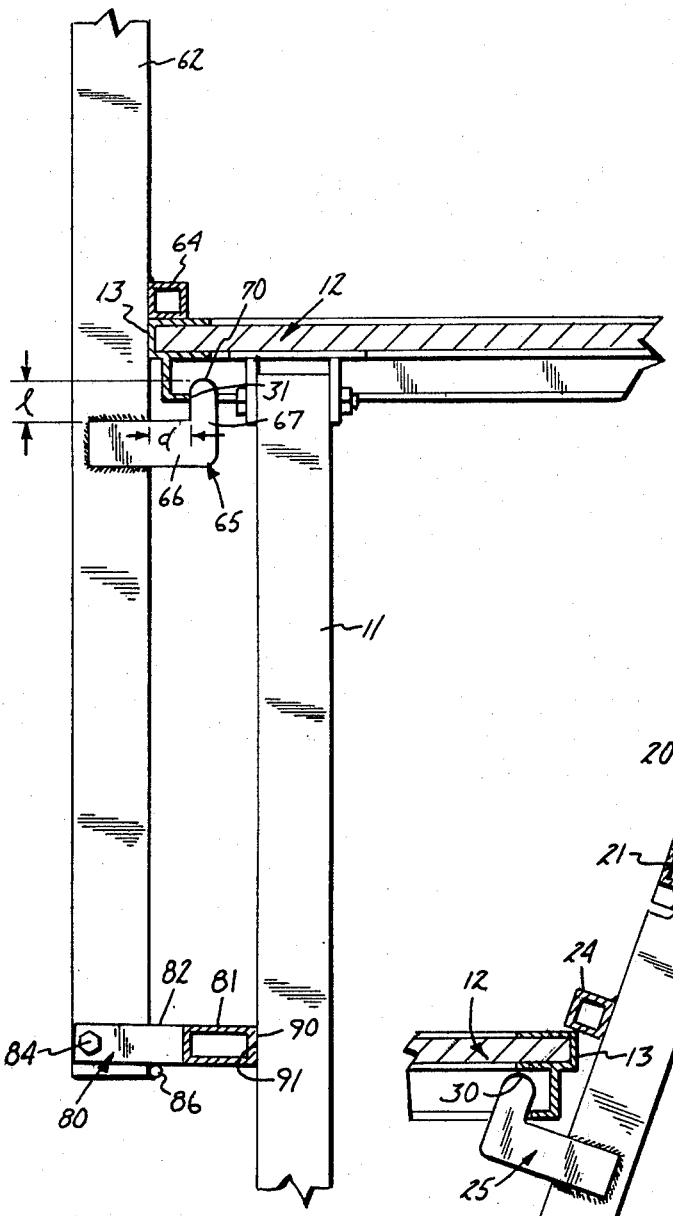
FIG. 4 is a fragmentary sectional view along the line 4—4 of FIG. 1.

Barrier 15 also includes a locking member 80 comprising a bar 81 pivotally connected by short stubs 82, 83 and pivot fasteners 84, 85 near the bottoms of posts 62, 63, all respectively, below the hook members. As shown in FIG. 4, member 62 is provided with a stop pin 86 to limit the clockwise movement of member 80 at a point where surface 90 of bar 81 substantially coincides with the surface 91 of leg 11. A similar pin 87 is provided at member 63.

Figure 5:
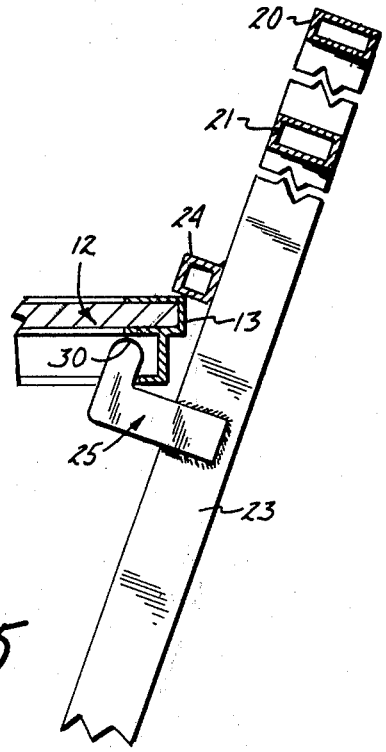
FIG. 5 is a view like FIG. 3 showing the barrier being installed on a stage.

A feature of the invention is the ease with which the barriers can be installed at the edges of the stage, as will now be described in connection with FIG. 5. Locking member 40 is first pivoted clockwise so that bar 41 is adjacent posts 22 and 23. The barrier is then tilted outwardly, positioned with the hook members behind flange 13, and lifted until termination 30 engages the under surface of traffic member 12. Now simply by tilting the barrier to an erect attitude, and allowing it to settle slightly, it may be positioned to rest on member 24 against the traffic member, with the hook members inside the flange. Finally, locking member is pivoted counterclockwise until bar 41 engages legs 11.

The lengths of members 43 are so chosen that when the inner faces of posts 22, 23 are against the outer edge of surface member 12, and the outward extensions of the hook members engage the inner edge 31 of flange 13, the corners of bar 41 slightly oppose movement of the locking member into or out of the operative position shown in FIG. 3, although this opposition can be overcome by force applied tangentially about pivots 44, 45 to bar 41. This has the result of reducing the likelihood that the locking member may be inadvertently pivoted out of its operative position by activity around the stage. It also has the result, in combination with the slight downward slope of studs 42, 43, that the probability of locking member 40 being forced out of its operative position by outward force exerted on top rail 20 is substantially obviated. The same situation prevails for locking member 80.

Installation of the barrier is now complete: barrier 15 is installed in the same fashion. Barrier removal is accomplished by a reversal of the steps of the installing process. Installation and removal are accomplished quickly and easily, without any separable fastener elements to become misplaced, and without the need of any tools whatever.

When the barrier is installed, it is prevented from downward movement by member 24, from inward movement by contact of the edge of the surface member with the inner faces of posts 22 and 23, from outward movement by the contact of the hook members with the inner rim of the flange, from outward tilting by contact of locking member 41 with legs 11, and from inward tilting by cooperation of support member 24 and the hook members with the surface member.

FIG. 6 is presented to show that the invention is equally applicable to a stage where the surface member 100 includes as a framing flange only a simple angle iron 101. Here the barrier 102 includes a support member 103 and the necessary number of hook members 104, dimensioned in horizontal and vertical extent in accordance with the dimensions of the framing flange and the overhang of the surface member therebeyond. It is understood that a locking member is provided for this arrangement as previously described.

In connection with FIGS. 3 and 6 it is to be noted that a distance L exists, when the barrier is installed, between the bottom of flange 13 (or angle iron 101) and the top of the horizontal extension of hook member 25 (or 104). It is clear from FIG. 5 that a certain minimum clearance is necessary here due to the geometry of the installation and removal procedures. Moreover, because of the likelihood that surface members 12 of different stages may be of different thicknesses, the upward extensions of the hook members are arbitrarily increased somewhat, and their locations on the posts are correspondingly lowered, to adapt the barrier to more universal usage.

From the foregoing, it will be evident that the invention comprises a new and useful barrier for removable installation at the edge of a portable stage, including a guard rail, means including a support member for supporting the guard rail on the edge of a stage surface member, means including a plurality of hook members for cooperating with a framing flange under the surface member to prevent outward movement of the guard rails, and means for preventing the guard rail from tilting outwardly away from the stage surface member, including a locking member pivotable into operative position after the barrier is positioned on the edge of the surface member.

Numerous characteristics and advantages of my invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed:

1. A guard rail for removable placement at the outer edge of a stage surface member having a framing flange affixed thereunder near the outer edge of the surface member and extending downward therefrom comprising, in combination:

(a) a barrier unit having front and rear faces;

(b) support means extending from said rear face of said barrier for gravitationally engaging said edge along substantially the entire length thereof;

(c) hook means having a first portion extending outwardly from said rear face of said barrier and having a second portion extending substantially vertically from said first portion so that said hook means may engage the flange when said guard rail is emplaced; and (d) locking means affixed to said barrier at a point below said hook means for applying a force in a horizontal direction to bias said second portion against the framing flange so that said guard rail is rigidly affixed to said stage.

2. A guard rail according to claim 1 wherein said locking means is releasable.

3. A guard rail according to claim 1 wherein said second portion of said hook mean is located a predetermined distance from said barrier to which it is attached, said distance being equal to the distance said flange extends away from said outer edge.

4. A guard rail according to claim 3 wherein said first portion of said hook means is spaced from said flange when the guard rail is installed on the stage so that clearance is provided to allow removal of said guard rail from the stage.

5. A guard rail according to claim 1 wherein said stage surface member is supported on legs and said barrier includes a top rail member and a pair of support posts.

6. A guard rail for the outer edge of a stage having elevating legs and a stage surface member supported by said legs, said surface member including a framing flange and extending downwardly from said surface member and said flange, comprising, in combination:

a top rail member;

a pair of spaced posts having top ends, secured to and projecting from said rail member, and generally parallel inner faces;

a support member connected to said inner faces of said posts at sites spaced from said rail member to interconnect said sites for gravitationally engaging the surface member; and hook member connected to said posts at sites more remote from said rail member than said support member, and extending inwardly and then generally toward said rail member, the inward extension of said hook members being substantially the same as the distance from the outer edge of said surface member to the inner edge of said framing flange, said hook having an upward extension, said inward extension of said hook member being spaced from said flange to provide clearance between said hook members and said flange for removing said barrier from said stage; and locking means affixed to said barrier at a point more remote from said rail than said hook members for applying a force in a horizontal direction to bias said upward extension against the flange so that said barrier is rigidly affixed to said stage.

7. In combination:

a stage having elevating legs and a stage surface member supported by said legs, said stage surface member including a framing flange and extending outwardly beyond said legs and said flange, and a protective barrier for the edge of a stage having elevating legs and a stage surface member supported by said legs, said surface member including a framing flange and extending outwardly beyond said legs and said flange, comprising, in combination:

a top rail member;

a pair of spaced posts having top ends, secured to and projecting from said rail member, and generally parallel inner faces;

a support member connected to said inner faces of said posts at sites spaced from said rail member to interconnect said sites for gravitationally engaging the surface member along the entire length of said support member; and hook member connected to said posts at sites more remote from said rail member than said support member, and extending inwardly and then generally toward said rail member, the inward extension of said hook members being substantially the same as the distance from the outer edge of said surface member to the inner edge of said framing flange, said hook having an upward extension, said inner extension of said hook member being spaced from said flange to provide clearance between said hook members and said flange for removing said barrier from said stage; and locking means affixed to said barrier at a point more remote from said rail than said hook members for applying a force in a horizontal direction to bias said upward extension against the flange so that said barrier is rigidly affixed to said stage.

* * * * *